US005463291A

United States Patent [19]

Carroll et al.

[11] Patent Number: 5,463,291

[45] Date of Patent: Oct. 31, 1995

[54] CYCLOTRON AND ASSOCIATED MAGNET COIL AND COIL FABRICATING PROCESS

[76] Inventors: Lewis Carroll, 3130 Lewiston Ave., Berkeley, Calif. 94705; George Hendry, 3104 Redwood Rd., Napa, Calif. 94558; Franck Picker, 117 Normandy Rd., Oak Ridge, Tenn. 37830

[21] Appl. No.: 178,375

[22] Filed: Dec. 23, 1993

[51] Int. Cl.[6] ..... H05H 13/00

[52] U.S. Cl. ..... 315/502; 335/210; 29/602.1; 29/605

[58] Field of Search ..... 328/234; 335/210; 315/502

[56] References Cited

U.S. PATENT DOCUMENTS

| | | | |
|---|---|---|---|
| 3,411,033 | 11/1968 | King | 315/382 |
| 3,622,869 | 11/1971 | Golay | 324/320 |
| 3,624,527 | 11/1971 | Hudson | 328/164 |
| 3,711,803 | 1/1973 | West | 335/210 |
| 3,789,335 | 1/1974 | Delphin et al. | 335/210 |
| 3,896,392 | 7/1975 | Hudson et al. | 328/234 |
| 3,921,019 | 11/1975 | Karasawa | 313/62 |
| 4,095,557 | 6/1978 | Croop et al. | 118/301 |
| 4,388,371 | 6/1983 | Bolon et al. | 428/383 |
| 4,442,417 | 4/1984 | Symons | 335/210 |
| 4,445,102 | 4/1984 | Thorn et al. | 335/297 |
| 4,694,868 | 9/1987 | Jahnke et al. | 140/92.1 |
| 4,709,470 | 12/1987 | Meier | 29/605 |
| 4,725,803 | 2/1988 | Prevot et al. | 335/299 |
| 4,745,367 | 5/1988 | Dustmann et al. | 328/235 |
| 4,771,208 | 9/1988 | Jongen et al. | 313/62 |
| 4,902,993 | 2/1990 | Krevet | 335/210 |
| 4,943,781 | 7/1990 | Wilson et al. | 315/502 |
| 4,987,398 | 1/1991 | Bessho | 335/299 |
| 5,152,480 | 10/1992 | Adams et al. | 244/134 D |

FOREIGN PATENT DOCUMENTS 8600014 4/1986 WIPO .

OTHER PUBLICATIONS

Hartwig, E., The AEG Compact Cyclotron, presented by H. Liesem, pp. 564–580.

Bol, Jean-Louis, et al., A New Kind of Economical Cyclotron for Radioisotope Production, 1986, Ion Beam Applications s.a.

*Primary Examiner*—Donald J. Yusko
*Assistant Examiner*—Lawrence O. Richardson
*Attorney, Agent, or Firm*—Pitts & Brittian

[57] ABSTRACT

A cyclotron and associated magnet coil and coil fabricating process. The cyclotron (10) includes a return yoke (12) defining a cavity (28) therein. A plurality of wedge-shaped regions called "hills" (29) are disposed in the return yoke (12), and voids called "valleys" (34) are defined between the hills (29). A single, substantially circular magnet coil (40) surrounds and axially spans the hills (29) and the valleys (34). The cyclotron magnet coil fabricating process includes the steps of securing a first end portion of a continuous length of sheet conductor to a substantially circular base, and positioning a first end portion of a length of insulator material coated on opposite sides with a thermosetting resin between the first end portion of the sheet conductor and the base. The length of sheet conductor and the length of insulator material are then wound about the base, and the magnet coil is heated to a temperature sufficient to cause the thermosetting resin to flow and wet adjacent turns of the sheet conductor.

19 Claims, 4 Drawing Sheets

CYCLOTRON AND ASSOCIATED MAGNET COIL AND COIL FABRICATING PROCESS

TECHNICAL FIELD

This invention relates to a cyclotron and associated magnet coil and coil fabricating process. In this particular invention the cyclotron utilizes a single magnet coil fabricated in accordance with the process of the present invention.

BACKGROUND ART

Modern cyclotrons employ a concept called "sector focusing" to constrain the vertical dimension of the accelerated particle beam within the poles of the cyclotron magnet.

The magnet poles contain at least three wedge-shaped sectors, commonly known as "hills", where the magnetic flux is mostly concentrated. The hills are separated by regions, commonly referred to as "valleys", where the magnet gap is wider. As a consequence of the wider gap the flux density, or field strength, in the valleys is reduced compared to that in the hills.

Vertical focusing of the beam is enhanced by a large ratio of hill field to valley field; the higher the ratio, the stronger are the forces tending to confine the beam close to the median plane. The tighter the confinement, in turn, the smaller the magnet gap may be (in principle) without danger of the beam striking the pole faces in the magnet.

This is important since, for a given amount of flux in the gap, a magnet with a small gap requires less electrical power for excitation than does a magnet with a large gap.

In the limiting case of the "separated sector cyclotron" each hill sector is a complete, separate, stand-alone magnet with its own gap, poles, return/support yoke, and excitation coil. In this implementation the valleys are merely large void spaces containing no magnet steel. Essentially all the magnetic flux is concentrated in the hills and almost none is in the valleys.

In addition to providing tight vertical focusing, the separated-sector configuration allows convenient placement of accelerating electrodes and other apparatus in the large void spaces comprising the valleys.

More recently, superconducting magnet technology has been applied to cyclotrons. In superconducting cyclotron designs, the valleys are also large void spaces in which accelerating electrodes and other apparatus may be conveniently emplaced. The magnet excitation for a superconducting cyclotron is usually provided by a single pair of superconducting magnet coils which encircle the hills and valleys. A common return/support yoke surrounds the excitation coil and magnet poles.

For a given radius of acceleration this configuration affords a much more compact and efficient structure than the separated-sector configuration.

The large hill-to-valley field ratio of the separated-sector cyclotron, combined with the relatively more compact and efficient physical implementation of the superconducting cyclotron, is embodied in the non-superconducting "deep-valley" magnet configuration disclosed in International Patent No. PCT/BE86/00014.

Whereas the "deep valley" cyclotron configuration achieves a high value magnetic field with relatively low excitation, there are inherent inefficiencies in having to utilize two magnet coils, and conventional coil designs have not taken full advantage of the inherent efficiencies of the "deep valley" cyclotron configuration. In this regard, conventional magnet coils are typically wound using insulated hollow-core conductor to allow water-cooling so as to remove heat from the interior of the windings. The conductor packing factor (the ratio of conductor volume to total volume) in coils utilizing such conductor is generally less than 50%, resulting in higher electrical resistance, relatively high power requirements, and more heat to be removed from the windings. Moreover, the hollow-core conductor commonly used for magnet coils is generally available only in short pieces which must be carefully joined and wrapped with insulation to make up the required lengths. The work must be done carefully and checked meticulously to insure leak-free joints of lasting electrical and mechanical integrity. After winding is complete, the coils are generally cured by vacuum potting in epoxy or by vacuum-varnish-impregnation to insure stability and durability. Accordingly, the overall process is lengthy, labor intensive and expensive.

Therefore, it is an object of the present invention to provide a cyclotron which utilizes a single magnet coil to achieve greater energy efficiency.

SUMMARY OF THE INVENTION

It is another object of the present invention to provide a magnet coil for a cyclotron which offers low electrical resistance and, thus, low power requirements.

Still another object of the present invention to provide a magnet coil for a cyclotron incorporating windings having a high conductor packing factor and offering high thermal conductivity.

Yet another object of the present invention is to provide a magnetic coil fabricating process which is less time consuming, less labor intensive and less expensive than fabricating processes heretofore utilized.

Other objects and advantages will be accomplished by the present invention which provides a cyclotron and associated magnet coil and coil fabricating process. The cyclotron of the present invention comprise a return yoke provided with a cavity therein, and at least three regions commonly referred to as "hills" within the return yoke. Each hill defines an upper hill section and a lower hill section separated by a first air gap for accommodating the accelerated particle beam. The hills are selectively spaced so as to provide voids commonly referred to as "valleys" therebetween, with the valleys defining further air gaps which are greater in width than the air gaps defined between the hill sections. The cyclotron magnet coil of the present invention is substantially circular and surrounds the hills, including the upper and lower hill sections and the air gap there between, and the valleys. Further, the coil defines at least one beam exit hole extending through the coil for accommodating the exiting of a particle beam from the cyclotron.

The cyclotron magnet coil fabricating process of the present invention comprises the steps of securing a first end portion of a continuous length of sheet conductor to a substantially circular base member or spool, and positioning the first end portion of a length of insulator material, the insulator material being coated on opposite sides with a bonding material, between the first end portion of the length of sheet conductor and the base member. In the preferred embodiment the insulator material comprises a polymer film and the bonding material comprises a thermosetting resin. The length of sheet conductor and the length of insulator material are then wound about the base member, and the magnet coil is heated to a temperature sufficient to cause the thermosetting resin to flow and wet adjacent turns of the sheet conductor. The coil is then allowed to cool such that the thermosetting resin hardens and bonds adjacent turns of the sheet conductor with the insulator material interposed therebetween.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

Figure 1:
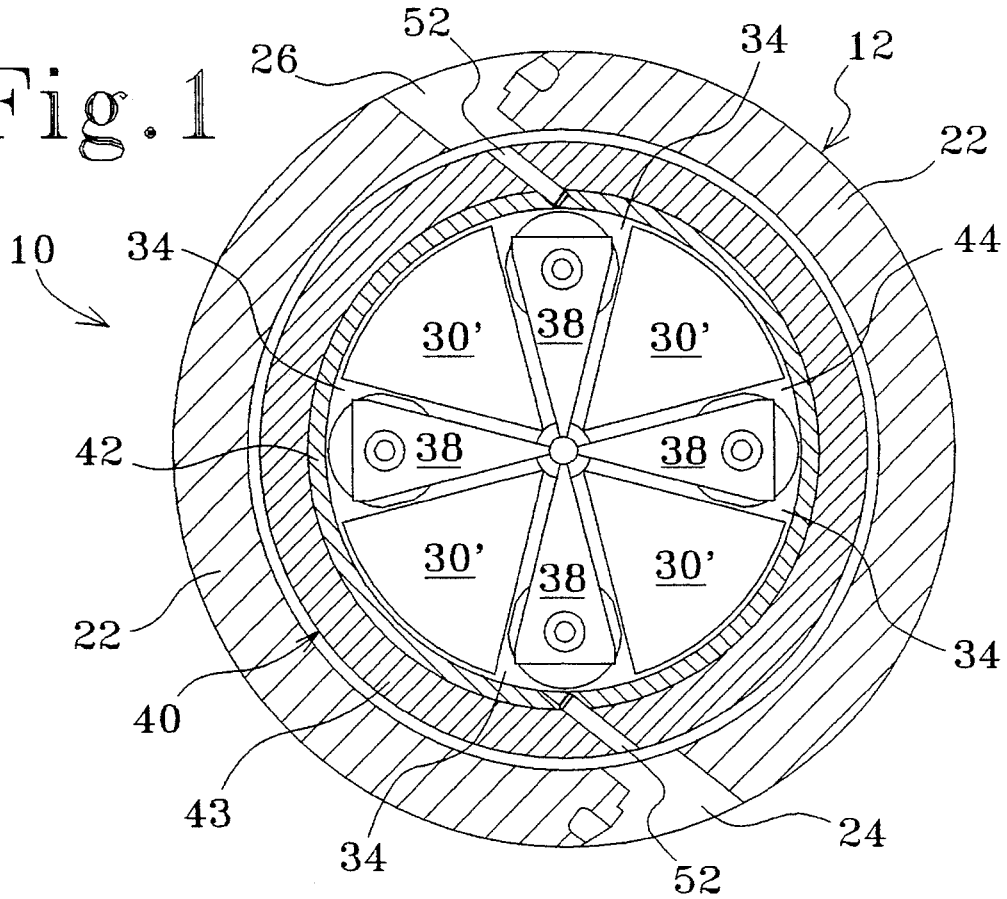
FIG. 1 illustrates a plan view, in section, of a cyclotron of the present invention.

A cyclotron incorporating various features of the present invention is illustrated generally at 10 in the Figures. The cyclotron 10 includes a return yoke 12 fabricated of a ferro-magnetic material such as steel. The return yoke 12 defines upper and lower yoke portions 14 and 16, respectively. In the preferred embodiment the yoke portions 14 and 16 are disc-shaped members which are coaxially positioned on an axis 18, and disposed parallel to, and selectively spaced from, a median plane 20 (see FIG. 2). The return yoke 12 also includes a further yoke portion 22 which is secured between the upper and lower yoke portions 14 and 16 proximate the perimeters of such upper and lower yoke portions so as to maintain the selective spacing of the yoke portions 14 and 16 and so as to ensure the desired return of magnetic flux.

Figure 2:
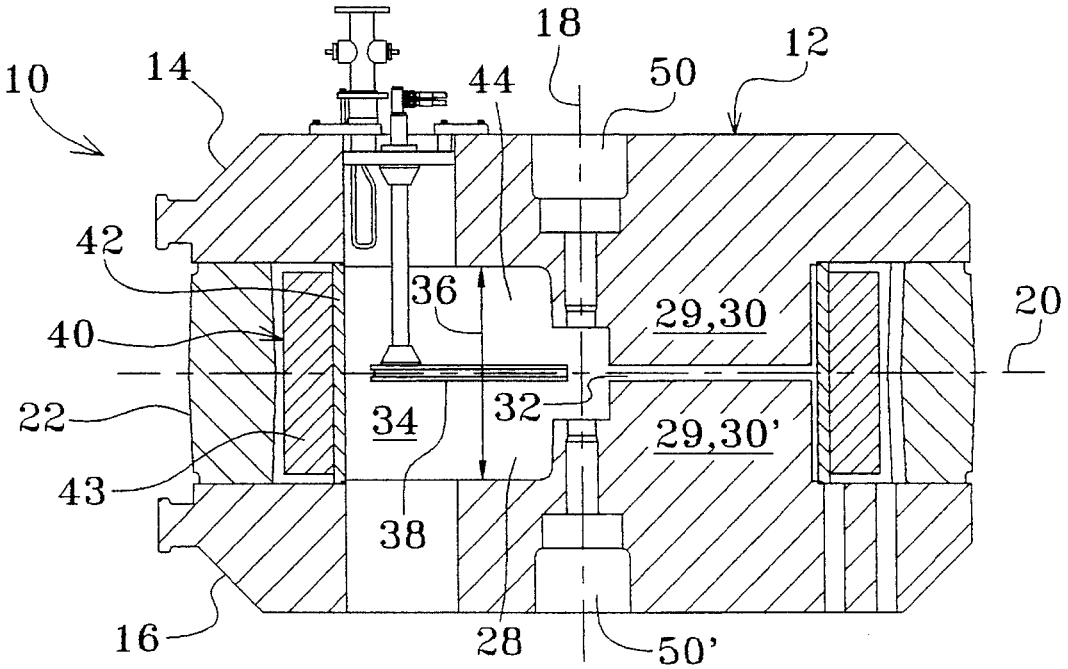
FIG. 2 illustrates a side elevation view, in section, of a cyclotron of the present invention.
Figure 3:
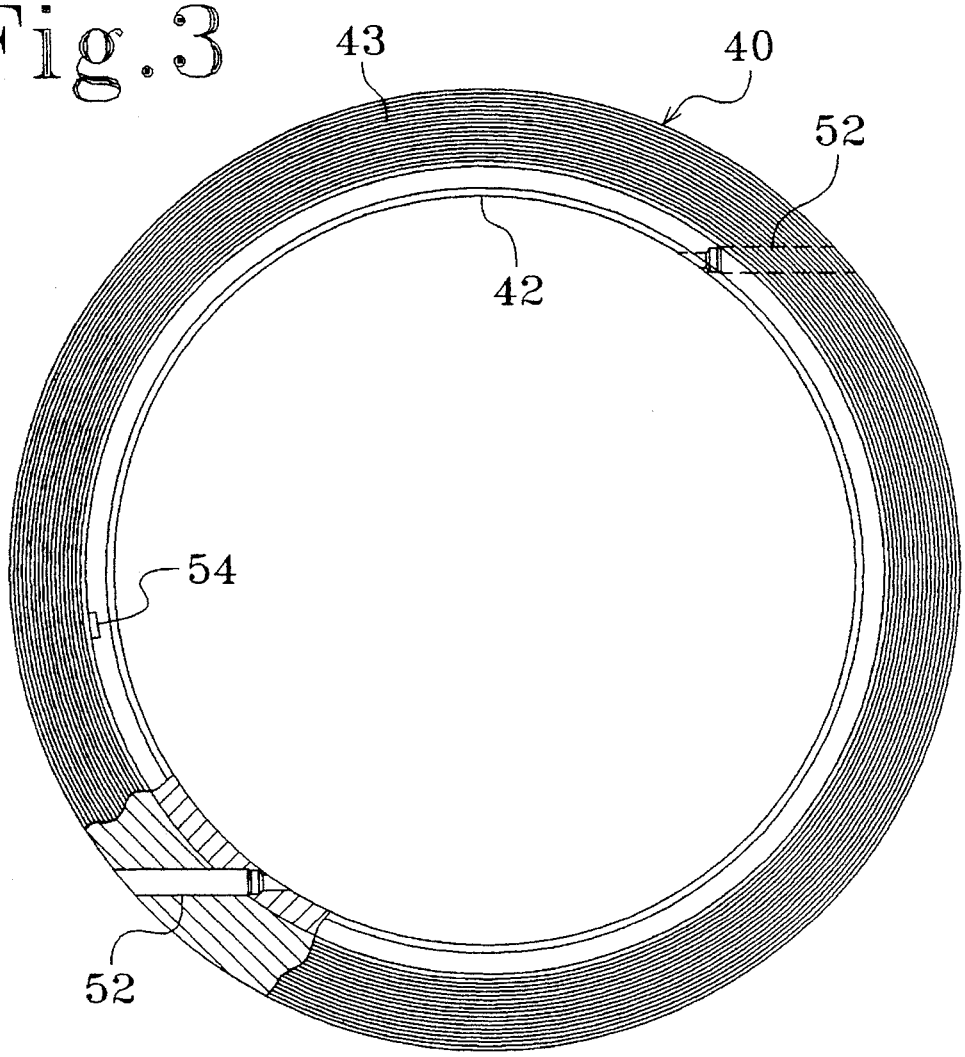
FIG. 3 illustrates a plan view, partially in section, of a magnet coil of a cyclotron of the present invention.
Figure 4:
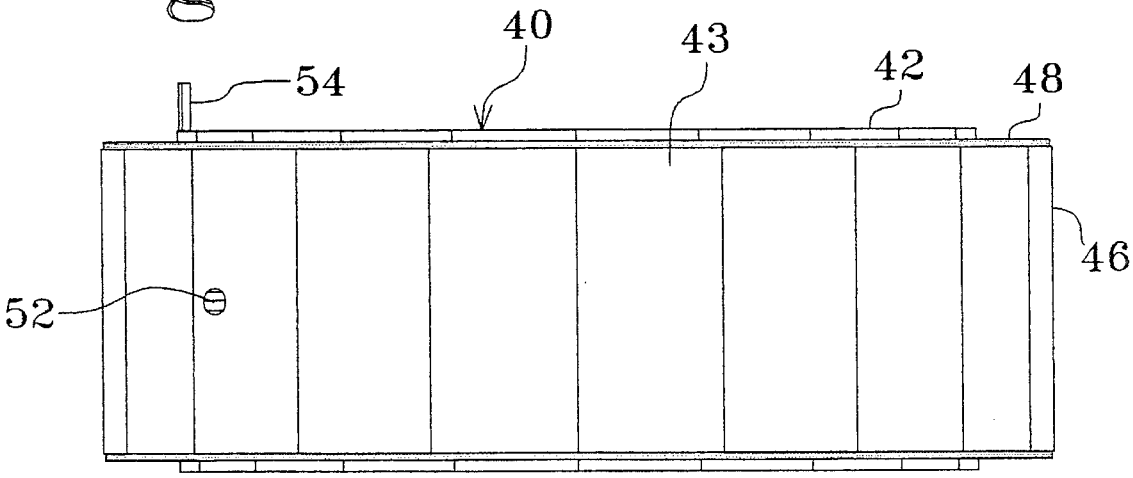
FIG. 4 illustrates a side elevation view of a magnet coil of a cyclotron of the present invention.
Figure 5:
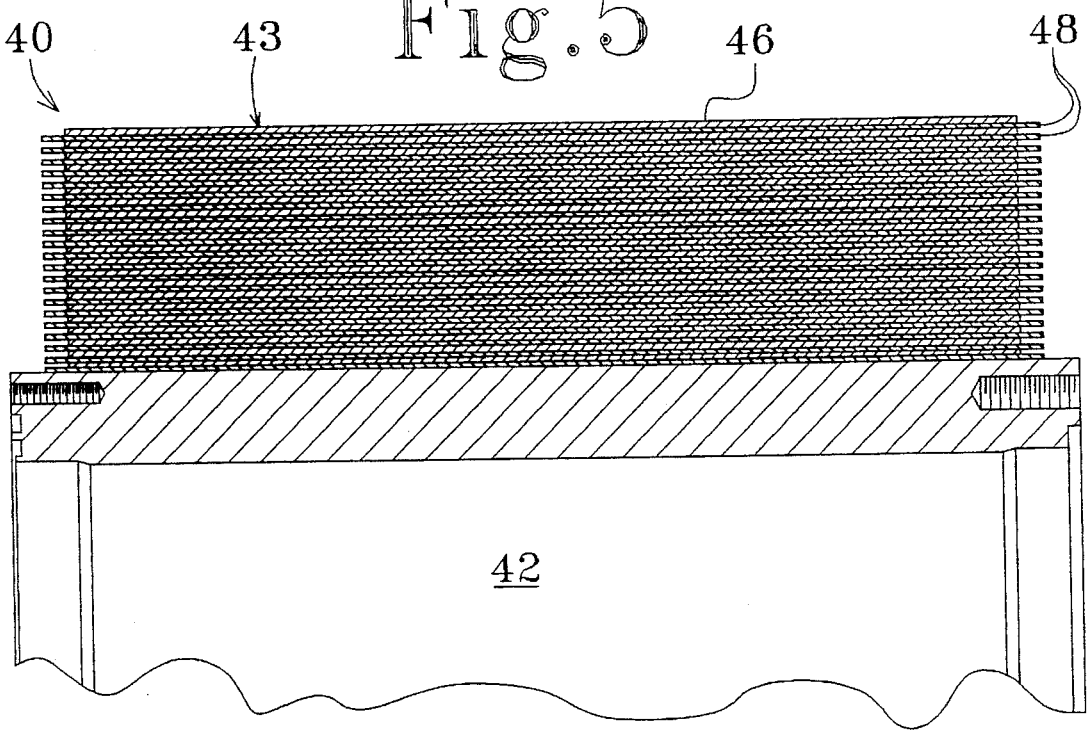
FIG. 5 illustrates a partial side elevation view, in section, of a magnet coil of a cyclotron of the present invention.

As best illustrated in FIGS. 1 and 2, the further yoke portion 22 is provided with at least one, and in the preferred embodiment, a pair of oppositely disposed beam exit ports 24 and 26 to accommodate the exiting of the particle beam from the cyclotron. It will be noted that in the preferred illustrated embodiment the further yoke portion 22 defines an integral cylindrical member which extends between the upper and lower yoke portions 14 and 16. However, if desired, the further yoke portion 22 can define a plurality of separate further yoke sections with spaces left between the yoke sections to accommodate the exiting of the particle beam.

Within the return yoke 12 at least three, and in the preferred illustrated embodiment four, substantially azimuthally symmetric, wedge-shaped regions commonly referred to as "hills" 29 are defined. The hills 29 include upper hill sections 30 and lower hill sections at 30', and define air gaps 32 between the hill sections 31 and 31' which are preferably just wide enough to permit passage of the particle beam. As illustrated in the FIG. 2, in the preferred embodiment the hill sections 30 and 30' are integrally formed with the upper and lower yoke portions 14 and 16. However, separately formed hill sections can be used if desired, with such hill sections being mechanically secured to the yoke portions 14 and 16.

Between the hills 29 voids or gaps commonly referred to as "valleys" 34 are defined, and, as illustrated in FIGS. 1 and 2, the valleys 34 accommodate the mounting of acceleration electrodes 38. In the valleys 34 air gaps 36 are defined (see FIG. 2) which are substantially wider than the air gaps 32 between the opposing hill sections 30 and 30'. In this regard, the ratio of the axial dimension of the air gaps 36 in the valleys 34 to the air gaps 32 between the hill sections is large. For example, on the order of five to ten or more. The ratio of hill-to-valley magnetic field intensities varies (to first order) inversely as the ratio of the gap dimensions. Thus, during operation, the magnetic field, or flux density, is substantially greater in the air gaps 32 between the hills than in the air gaps 36. As a result of the concentration of the magnetic flux in the air gaps 32 a high value magnetic field can be achieved with relatively low excitation.

Unlike conventional cyclotrons which incorporate a plurality of magnet coils, in the cyclotron 10 a single magnet coil 40 surrounds the hills 29 and valleys 34. In this regard, in the preferred embodiment the coil 40 is substantially circular and defines a height, or axial dimension, which substantially spans the distance between the yoke portions 14 and 16, such that the axial dimension of the coil 40 is substantially the same as the axial dimension of the hill sections 30 and 30', and the air gap 32 therebetween.

More specifically, in the preferred embodiment the coil 40 includes a substantially circular base member 42 which extends between the upper yoke portion 14 and lower yoke portion 16, and which receives the coil windings 43. As illustrated, the base member 42 and the yoke portions 14 and 16 cooperatively define the vacuum chamber 44 of the cyclotron in which the hill sections 30, 30' and valleys 34, 34' are disposed, thereby obviating the need for a separate vacuum chamber wall between the yoke portions 14 and 16.

As best illustrated in FIGS. 3–8, the coil windings 43 of the magnet coil 41 include a continuous winding of sheet conductor 46, such as a copper sheet conductor, with a continuous length of sheet insulator material 48 as an electrical insulating layer between turns of the coil. The insulator material 48 is preferably a high-temperature, high-dielectric-strength polymer film such as Kapton® manufactured by DuPont. However, it is contemplated that various other insulator materials can be used. As discussed in detail below, the insulator material 48 incorporates a coating of an adhesive or bonding material on both its upper and lower surfaces 49 and 51, respectively, which serves to bond the turns of the sheet conductor 46 between the insulator material 48. In the preferred embodiment the bonding material is a high-temperature thermosetting resin such as #2290 manufactured by 3M Corporation®.

In the cyclotron 10, essential apparatus such as ion source, beam extractor, vacuum pumping apertures, etc. (not shown) are introduced axially, as, for example, through the illustrated axial conduits 50 or 50' provided in the return yoke 12, such that these components do not require penetration of the magnet coil 41. However, in order to transport the beam of energetic particles out of the cyclotron, one or more beam exit holes 52 are provided in the coil 41. As illustrated in FIG. 1, the beam exit holes 52 register with the beam exit ports 24 and 25 of the further yoke portion 22 in order to accommodate the exiting of the particle beam.

Figure 6:
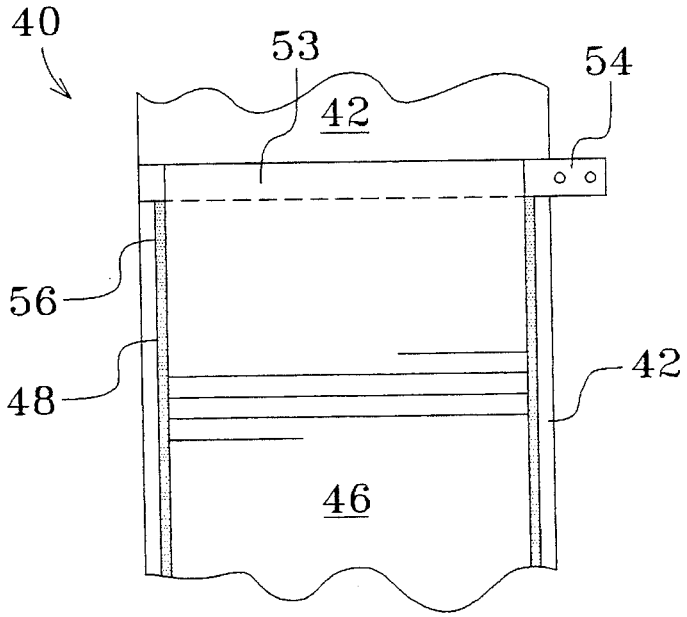
FIG. 6 illustrates a partial side elevation view of a magnet coil of a cyclotron of the present invention.
Figure 7:
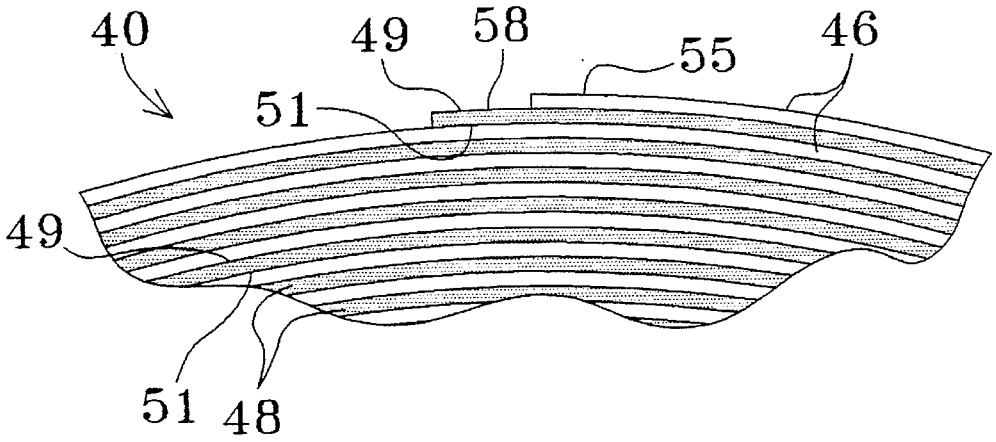
FIG. 7 illustrates a partial side elevation view of a magnet coil of a cyclotron of the present invention.
Figure 8:
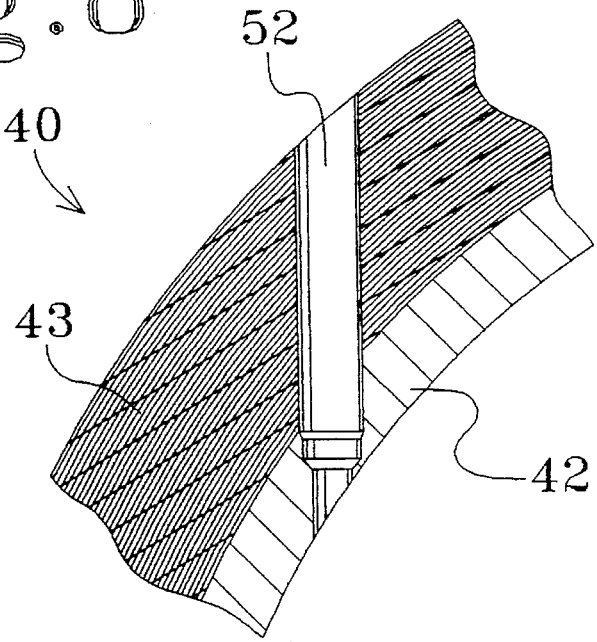
FIG. 8 illustrates a partial plan view, in section, of a magnet coil of a cyclotron of the present invention.

In accordance with the coil fabricating process of the present invention, the coil 40 is constructed by securing a first end 53 of the sheet conductor 46 to the base member 42. In this regard, in the preferred application of the process, a ground bus member 54 is secured to the base member 42, the ground bus member 54 preferably being fabricated from copper. The first end 53 of the sheet conductor 46 is then soldered to, or otherwise secured to, the ground bus member 54, as illustrated in FIG. 6. A first end portion 56 of the insulator material 48, (the insulator material being coated on both sides with bonding material) is interposed between the sheet conductor 46 and the base member 42, as illustrated in FIG. 6. The sheet conductor 46, with the underlying insulator material 48 is then wound about the base member 42 a selected number of turns. As illustrated in FIG. 7, the terminating end portion 58 of the insulator material 48 extends beyond the terminating end 55 of the sheet conductor 46 to obviate contact between the terminating end 55 and the sheet conductor 46 of the underlying coil turn.

After the winding operation is completed, and if the bonding material utilized to coat the insulator material is the preferred high-temperature thermosetting resin, the coil 40 is "cured" by heating the coil to a high enough temperature to cause the resin to flow and wet adjacent turns of the sheet conductor 46. This heating operation can be accomplished by covering the coil 40 with a thermal blanket and applying electrical power in the absence of water cooling so as to heat the coil to the curing temperature of the resin. The coil 40 is then cooled so as to harden the resin, thereby bonding the turns of the sheet conductor 46 together with the insulator material 48 interposed therebetween. This wetting and bonding action of the resin not only serves to secure the turns of the sheet conductor 46, but also results in high thermal conductivity throughout the coil.

After the resin has been cured, at least one beam exit hole 52 is bored in the coil 40 along a predetermined trajectory to accommodate the exiting of the particle beam. Turn-to-turn shorts resulting from the boring operation are eliminated by chemically etching the sheet conductor material after boring so that the edges of each layer of sheet conductor exposed by the boring operation lie behind adjacent layers of insulator material 48.

In light of the above, it will be recognized that the cyclotron and associated magnet coil of the present invention provides great advantages over the prior art. The wide sheet conductor 46, such sheet conductor being substantially the width of the magnet poles (hill sections 30, 30') plus the air gap 32, in conjunction with the thin polymer film insulator material 48 allow a very high conductor packing factor. This means that for a given number of ampere turns of magnet excitation, the coil can have a substantially lower electrical resistance than coils of the prior art. This, in turn, translates into a lower electrical power requirement. Further, lower electrical power means that less heat must be removed from the interior of the coil. As a result, a simple water-cooled jacket on the perimeter of the coil is generally sufficient for cooling purposes.

The coil fabricating process of the present invention also has great advantages over the prior art. The process utilizes long continuous lengths of sheet conductor and insulator material obviating the need to join relatively short pieces of hollow-core conductor and insulator. As a result, the magnet coil 40 can be wound in one continuous, automated operation. Further, the coil insulation incorporates a thermosetting resin which is easily cured, thereby simplifying the bonding operation and enhancing the thermal conductivity of coil.

In light of the above it will be recognized that the present invention provides a cyclotron and associated magnet coil and coil fabricating process having great advantages over the prior art. However, while a preferred embodiment has been shown and described, it will be understood that there is no intent to limit the invention to such disclosure, but rather it is intended to cover all modifications and alternate constructions and alternate process applications falling within the spirit and scope of the invention as defined in the appended claims.

We claim:

1. A cyclotron comprising:

a return yoke provided with a cavity therein;

a plurality of hill regions within said return yoke, each said hill region defining an upper hill section and a lower hill section separated by a first air gap for accommodating a particle beam, said hill regions being selectively spaced so as to provide valley regions therebetween defining further air gaps greater in width than said first air gaps; and a substantially circular magnet coil surrounding said hill regions and said valley regions, said coil defining a coil body including coil windings, and having at least one beam exit hole extending through said coil body for accommodating the exiting of a particle beam from said cyclotron.

2. The cyclotron of claim 1 wherein said return yoke includes an upper yoke portion and a lower yoke portion selectively spaced from said upper yoke portion, and wherein said magnet coil defines an axial dimension substantially spanning the distance between said upper yoke portion and said lower yoke portion.

3. The cyclotron of claim 1 wherein said magnet coil includes windings of sheet conductor with sheet insulator material disposed between turns of said sheet conductor.

4. The cyclotron of claim 1 wherein said magnet coil includes coil windings defining a continuous winding of sheet conductor with a continuous length of sheet insulator material disposed between turns of said sheet conductor.

5. The cyclotron of claim 2 wherein said magnet coil includes coil windings defining a continuous winding of sheet conductor with a continuous length of sheet insulator material disposed between turns of said sheet conductor.

6. The cyclotron of claim 3 wherein said sheet insulator material defines opposing surfaces coated with a bonding material.

7. The cyclotron of claim 4 wherein said sheet insulator material defines opposing surfaces coated with a bonding material.

8. The cyclotron of claim 7 wherein said sheet insulator material is a polymer film.

9. The cyclotron of claim 7 wherein said bonding material is a thermosetting resin.

10. The cyclotron of claim 7 wherein said sheet insulator material is a polymer film and said bonding material is a thermosetting resin.

11. A magnet coil for a cyclotron, said coil comprising a base member and a continuous winding of sheet conductor disposed about said base member with a continuous length of sheet insulator material disposed between turns of said sheet conductor, said magnet coil defining at least one beam exit hole extending through said coil for accommodating the exiting of a particle beam from said cyclotron.

12. The magnet coil of claim 11 wherein said sheet insulator material defines opposing surfaces coated with a bonding material.

13. The magnet coil of claim 11 wherein said sheet insulator material is a polymer film.

14. The magnet coil of claim 12 wherein said bonding material is a thermosetting resin.

15. The magnet coil of claim 12 wherein said sheet insulator material is a polymer film and said bonding material is a thermosetting resin.

16. A magnet coil for a cyclotron, said cyclotron having a return yoke provided with a cavity therein and a plurality of hill regions within said return yoke, each said hill region defining an upper hill section and a lower hill section separated by a first air gap for accommodating a particle beam, said hill regions being selectively spaced so as to provide valley regions therebetween defining further air gaps greater in width than said first air gaps, said magnet coil comprising:

a cylindrical magnet coil surrounding, and defining an axial dimension for substantially spanning, said hill regions and said valley regions of said cyclotron, said coil defining a coil body including coil windings, and having at least one beam exit hole extending through, and formed in, said coil windings for accommodating the exiting of a particle beam from said cyclotron.

17. A magnet coil fabricating process for fabricating a magnet coil for a cyclotron, said process comprising the steps of:

securing a first end portion of a length of sheet conductor to a substantially circular base member;

positioning a first end portion of a length of insulator material coated on opposite sides with a bonding material between said first end portion of said length of sheet conductor and said base member;

winding said length of sheet conductor and said length of insulator material about said base member; and boring at least one beam exit hole through said coil.

18. A magnet coil fabricating process for fabricating a magnet coil for a cyclotron, said process comprising the steps of:

securing a first end portion of a continuous length of sheet conductor to a cylindrical base member;

positioning a first end portion of a continuous length of insulator material coated on opposite sides with a bonding material between said first end portion of said length of sheet conductor and said base member, said insulator material comprising a polymer film and said bonding material comprising a thermosetting resin;

winding said length of sheet conductor and said length of insulator material about said base member;

heating said magnet coil to a temperature sufficient to cause said thermosetting resin to flow and wet adjacent turns of said sheet conductor;

allowing said thermosetting resin to cool whereby said thermosetting resin hardens and bonds adjacent turns of said sheet conductor with said insulator material interposed therebetween; and boring at least one beam exit hole through said sheet conductor and said insulator material of said coil.

19. The coil fabricating process of claim 18 wherein said process comprises the further step of chemically etching the edges of said sheet conductor abutting said beam exit hole such that said edges of said sheet conductor abutting said beam exit hole lie behind adjacent layers of said insulator material.

* * * * *